US005630666A

United States Patent [19]

Rodriguez

[11] Patent Number: 5,630,666

[45] Date of Patent: May 20, 1997

[54] CONE-SHAPED PAINT CONTAINER

[76] Inventor: Ernesto Rodriguez, 1509 N. 6th St., Carrizo Springs, Tex. 78834-1820

[21] Appl. No.: 610,325

[22] Filed: Mar. 4, 1996

[51] Int. Cl.[6] ..... B01F 7/18; B01F 15/02

[52] U.S. Cl. ..... 366/192; 366/325.2; 366/605; 222/185.1; 222/520; 251/144; 251/215

[58] Field of Search ..... 366/64–66, 184, 366/192, 194–196, 325.2, 341–343, 605; 222/185.1, 519, 520; 251/144, 215, 216, 351

[56] References Cited

U.S. PATENT DOCUMENTS

| | | | |
|---|---|---|---|
| 341,476 | 5/1886 | Greuloch, Jr. | 251/216 X |
| 1,253,218 | 1/1918 | Doremus | 222/185.1 X |
| 1,457,743 | 6/1923 | Morris | 251/144 |
| 2,519,707 | 8/1950 | Schaffer | 222/185.1 |
| 2,851,257 | 9/1958 | Morgan | 366/195 |
| 3,249,342 | 5/1966 | Mikkelsen | 366/195 X |
| 3,742,664 | 7/1973 | Reding | 222/185.1 X |
| 3,948,481 | 4/1976 | Pollock | 251/144 X |
| 4,050,678 | 9/1977 | Smith | 366/605 X |
| 4,703,775 | 11/1987 | Pastrone | 251/215 X |
| 4,880,312 | 11/1989 | Carlson | 366/605 X |
| 5,090,815 | 2/1992 | Bohle | 366/192 |

*Primary Examiner*—Charles E. Cooley

[57] ABSTRACT

A paint can comprising a container having an upper portion formed in cylindrical configuration and a lower portion formed in an inverted cone shaped configuration, the lower portion having an aperture with internal female threads at its lower central extent; a plurality of downwardly extending legs secured at their upper ends to the container adjacent to the lower end of the upper portion and the upper end of the lower portion to maintain the threaded opening at an elevated location for the dispensing of paint; and a threaded bolt threadedly received in the opening with a knurled knob at its lower extent and an inverted cone-shaped stopper at its upper extend positionable in bearing contact with the interior surface of the container and for rotation by a user between a lower orientation to maintain paint within the container and an upper orientation to allow the dispensing of paint from the container.

2 Claims, 3 Drawing Sheets

CONE-SHAPED PAINT CONTAINER

BACKGROUND OF THE INVENTION

1. Field of the Invention

The present invention relates to paint can and more particularly pertains to make mixing and transferring paint to other containers easier and less wasteful.

2. Description of the Prior Art

The use of paint cans of various design and configuration is known in the prior art. More specifically, paint cans of various design and configuration heretofore devised and utilized for the purpose of mixing paint and transferring such mixed paint to other containers through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des. 304,014 to O'Connell discloses an ornamental design for a paint container.

U.S. Pat. No. Des. 245,450 to Donlon discloses a paint can with an ornamental design.

Lastly, U.S. Pat. No. 5,316,169 to Gallagher discloses a ringless paint container with drip free lid.

In this respect, the paint can according to the present invention substantially departs from the conventional concepts and designs of the prior art, and in doing so provides an apparatus primarily developed for the purpose of to make mixing and transferring paint to other containers easier and less wasteful.

Therefore, it can be appreciated that there exists a continuing need for new and improved paint can which can be used for to make mixing and transferring paint to other containers easier and less wasteful. In this regard, the present invention substantially fulfills this need.

SUMMARY OF THE INVENTION

In view of the foregoing disadvantages inherent in the known types of paint cans of various design and configuration now present in the prior art, the present invention provides an improved paint can. As such, the general purpose of the present invention, which will be described subsequently in greater detail, is to provide a new and improved paint can and method which has all the advantages of the prior art and none of the disadvantages.

To attain this, the present invention essentially comprises a new and improved paint can designed to make mixing and transferring paint to other containers easier and less wasteful comprising a container having an upper portion formed in cylindrical configuration and a lower portion formed in an inverted cone shaped configuration, the lower portion having an aperture with internal female threads at its lower central extent.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint can which have all the advantages of the prior art paint cans of various design and configuration and none of the disadvantages.

It is another object of the present invention to provide new and a improved paint can which may be easily and efficiently manufactured and marketed.

It is further object of the present invention to provide a new and improved paint can which are of durable and reliable constructions.

An even further object of the present invention is to provide a new and improved paint can which are susceptible of a low cost of manufacture with regard to both materials and labor, and which accordingly are then susceptible of low prices of sale to the consuming public, thereby making such paint can economically available to the buying public.

Still yet another object of the present invention is to provide a new and improved paint can which provide in the apparatuses and methods of the prior art some of the advantages thereof, while simultaneously overcoming some of the disadvantages normally associated therewith.

Even still another object of the present invention is to make mixing and transferring paint to other containers easier and less wasteful.

Lastly, it is an object of the present invention to provide a new and improved paint can comprising a container having an upper portion formed in cylindrical configuration and a lower portion formed in an inverted cone shaped configuration, the lower portion having an aperture with internal female threads at its lower central extent; a plurality of downwardly extending legs secured at their upper ends to the container adjacent to the lower end of the upper portion and the upper end of the lower portion to maintain the threaded opening at an elevated location for the dispensing of paint; and a threaded bolt threadedly received in the opening with a knurled knob at its lower extent and an inverted cone-shaped stopper at its upper extend positionable in bearing contact with the interior surface of the container and for rotation by a user between a lower orientation to maintain paint within the container and an upper orientation to allow the dispensing of paint from the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
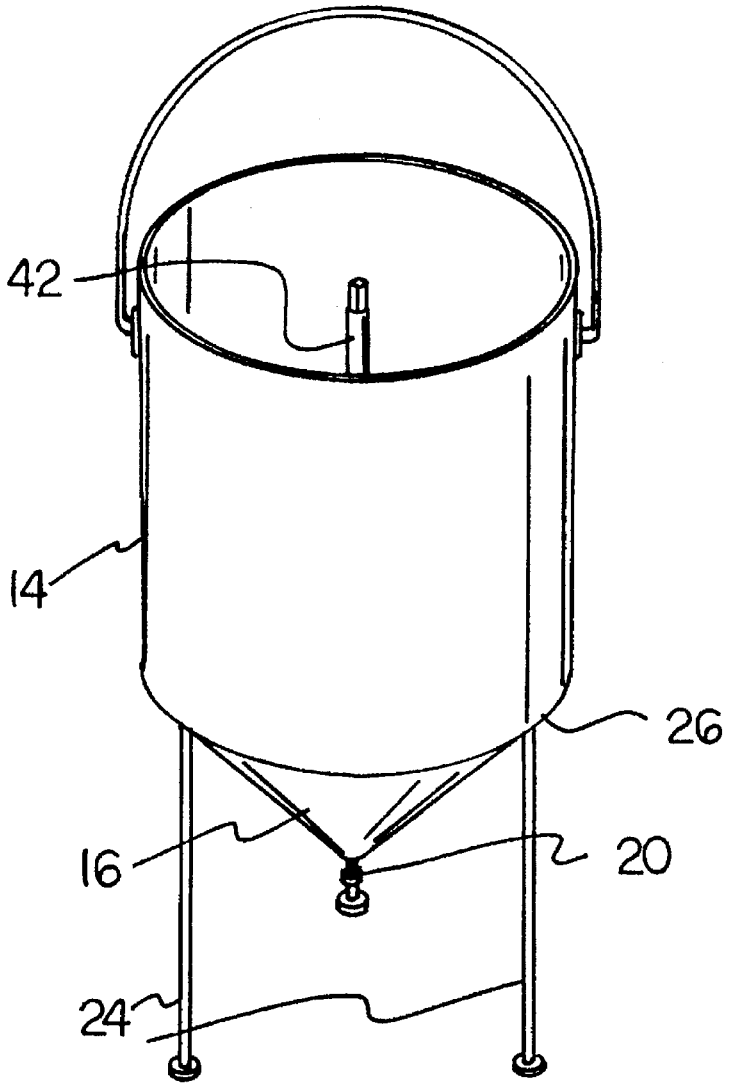
FIG. 1 is a perspective illustration of the preferred embodiment of the new and improved paint can constructed in accordance with the principles of the present invention.
Figure 2:
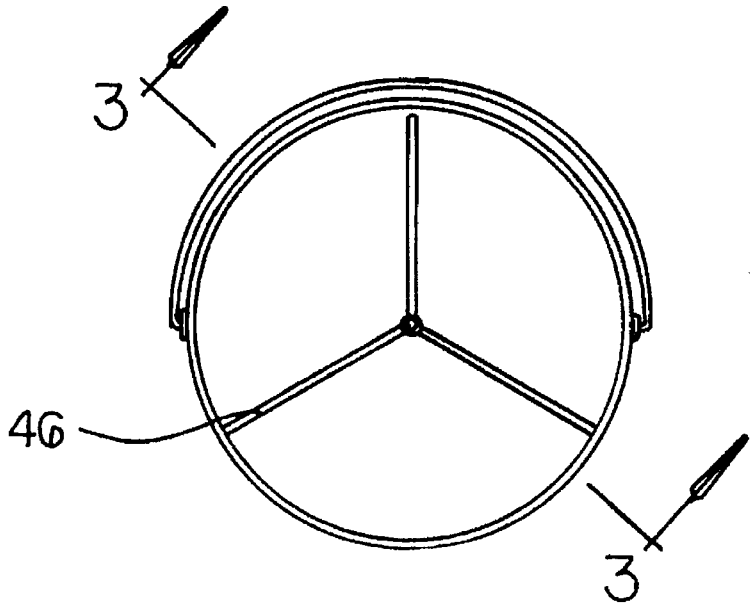
FIG. 2 is a top plan view of the apparatus shown in FIG. 1.

With reference now to the drawings, and in particular to FIG. 1 thereof, the preferred embodiment of the new and improved paint can embodying the principles and concepts of the present invention and generally designated by the reference numeral 10 will be described.

The present invention, the new and improved paint can is comprised of a plurality of components. Such components in their broadest context include container, legs, bolt, knob, stirrer, blades and handle. Such components are individually configured and correlated with respect to each other so as to attain the desired objective.

The present invention may be construed as a system 10. The central component of such a system is a container 12. Such container has an upper portion 14 formed in a cylindrical configuration. The container also has a lower portion 16 formed in an inverted cone-shaped configuration. The lower portion has an threaded opening 18 with internal female threads 20 formed at its lower central extend.

Formed integrally with the container are a plurality of downwardly extending legs 24. Such legs are preferably 3 in number. They are secured at their upper ends 26 to the container adjacent to the lower end of the upper portion and the upper end of the lower portion. The legs function to maintain the container and its threaded opening at an elevated location for the dispensing of paint by pouring through the aperture at the lower central extent of the container into a supplemental can therebeneath.

Next provided is a threaded bolt 30. Such bolt has external male threads 32 and is received in the opening of the container. The bolt includes an knurled knob 34 at its lower extent. In addition, the bolt has an inverted cone-shaped stopper 36 at its upper extent. The stopper is positionable in bearing contact with the interior surface of the container when it is intended that no paint is to be poured from the container. The bolt is adapted to be rotated by a user through the rotation of the knurled knob between the lower orientation to maintain paint within the container. It is also adapted to be rotated to an upper orientation wherein paint is allowed to be dispensed through a bore 35 formed in the bolt from the container to a supplemental can or other container beneath the opening in the container.

Next provided as a component of the system is a stirrer 40. The stirrer is positionable within the container. The stirrer has a vertical shaft 42. The shaft is formed with an adaptor at its upper end. Such adaptor is for being coupled to a drill. This allows for rotation of the adaptor, stirrer and vertical shaft for stirring paint within the container. The stirrer also has a lower end adjacent to the threaded openings.

Coupled with respect to the stirrer are three equally spaced blades 46. The blades are coupled to the lower end of the shaft in a generally "V" shaped configuration. Each blade thus has a lower end coupled with respect to the lower end of the vertical shaft. Each blade also has an upper end positioned adjacent to the upper end of the lower portion of the container. The lower portion of the container and the blades are essentially parallel with respect to each other. The lower portion of the container and blades form an angle of between about 30 degrees and 60 degrees with respect to the axis of the container and shaft.

Figure 3:
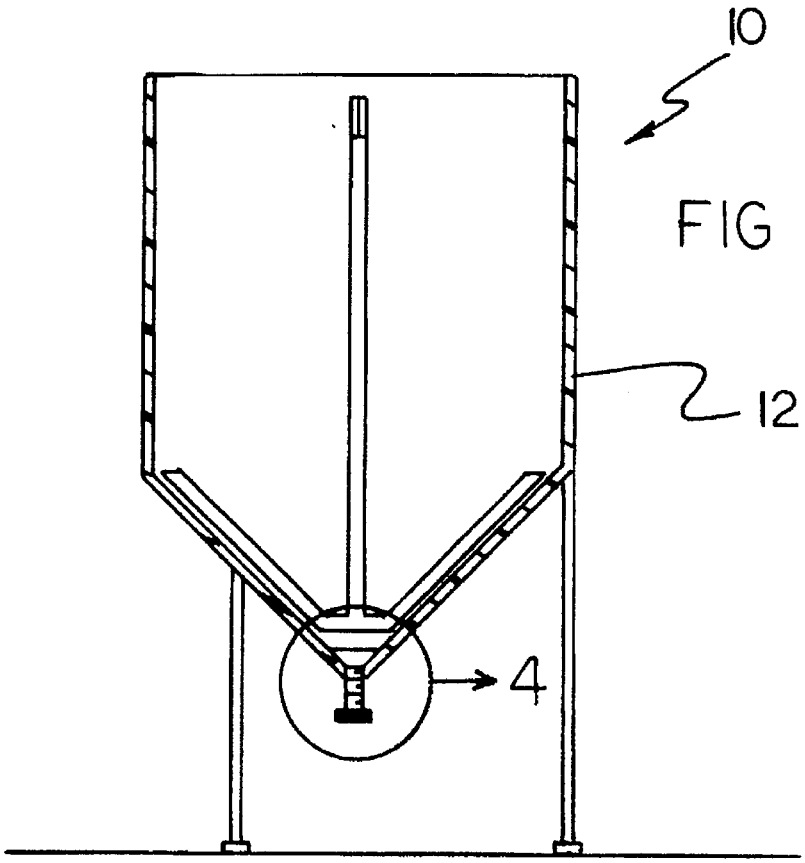
FIG. 3 is a cross-sectional view of the apparatus shown in FIGS. 1 and 2 taken along line 3—3 of FIG. 2.
Figure 4:
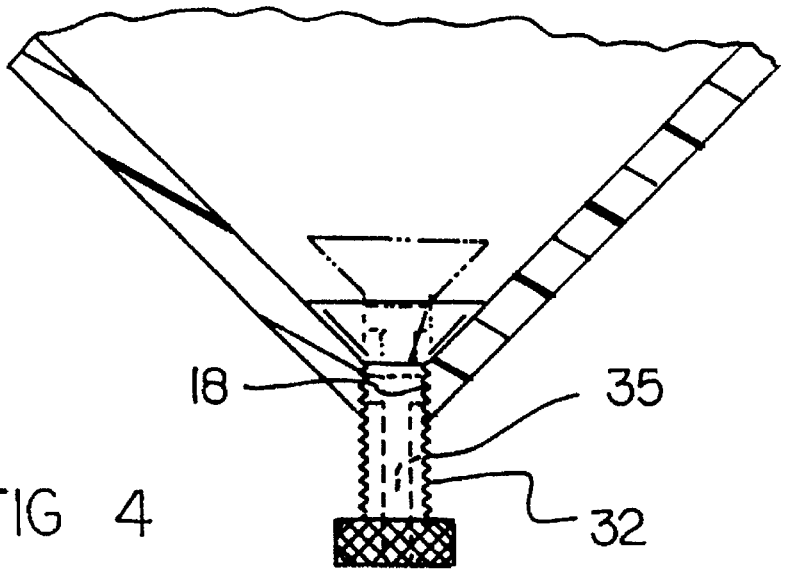
FIG. 4 is an enlarged cross-sectional view taken at circle 4 of FIG. 3.
Figure 5:
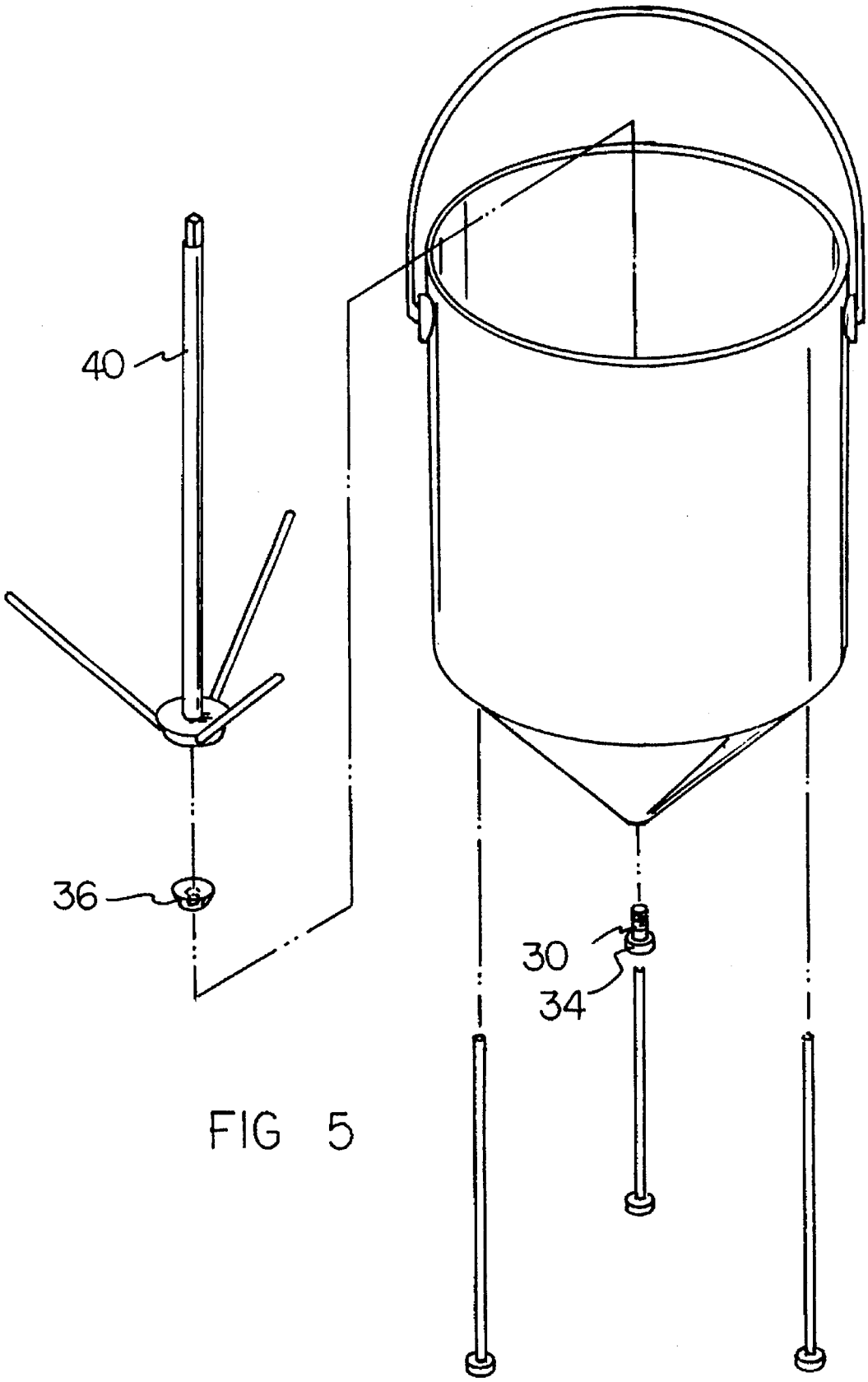
FIG. 5 is an exploded perspective view of the apparatus shown in the prior Figure.

Lastly provided is a component of the system 10 is an inverted "C" shaped handle. Such handle has free ends rotatably coupled to the exterior surface of the upper portion of the container. Such coupling is adjacent the upper extent of the container. Lastly, as can be seen in FIGS. 1, 3 and 5, the upper extent of the container is uncovered for the adding of paint to the container in order to be stirred and poured to a supplemental container.

The present invention, a new style paint can designed to make mixing and transferring paint easier and less wasteful. All the components are made of clear plastic with the can and top being circular and the can coming to a cone shape at the bottom. The inner surface is coated to prevent paint from sticking to it. A shaft is located inside the can in the center with three blades attached. Three legs are attached to the bottom of the can with enough room between the legs to permit a roller pan to slide under the paint can. A twist open and close exit is located in the bottom of the can. This device wastes less paint since there is no sticking to the inside of the can and the new style container can be used many times over.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved paint can designed to make mixing and transferring paint to other containers easier and less wasteful comprising, in combination:

a container having an upper portion formed in a cylindrical configuration and a lower portion formed in an inverted cone shaped configuration, the lower portion having a threaded opening with internal female threads at its lower central extent;

a plurality of downwardly extending legs secured at their upper ends to the container adjacent to the lower end of the upper portion and the upper end of the lower portion to maintain the threaded opening at an elevated location for the dispensing of paint;

a threaded bolt threadedly received in the threaded opening with a knurled knob at its lower extent and an inverted cone-shaped stopper at its upper extent positionable in bearing contact with the interior surface of the container and for rotation by a user between a lower orientation to maintain paint within the container and an upper orientation to allow the dispensing of paint from the container;

a stirrer positioned within the container having a vertical shaft with an adapter at its upper end for being coupled to a drill for rotation thereof and having a lower end adjacent to the threaded opening, the stirrer including three equally spaced blades in a generally V-shaped configuration each with a lower end coupled with respect to the lower end of the vertical shaft and each having an upper end positioned adjacent to the upper end of the lower portion of the container, the lower portion of the container and the blades being essentially parallel with respect to each other and forming an interior angle of between about 30 and 60 degrees from the axis of the container and the shaft; and an inverted C-shaped handle having free ends rotatably coupled to the exterior surface of the upper portion of the container adjacent to an upper extent thereof.

2. A paint can comprising:

a container having an upper portion formed in a cylindrical configuration and a lower portion formed in an inverted cone-shaped configuration, the lower portion having a threaded opening with internal female threads at its lower central extent;

a plurality of downwardly extending legs secured at their upper ends to the container adjacent to the lower end of the upper portion and the upper end of the lower portion to maintain the threaded opening at an elevated location for the dispensing of paint;

a threaded bolt threadedly received in the threaded opening with a knurled knob at its lower extent and an inverted cone-shaped stopper at its upper extent positionable in bearing contact with the interior surface of the container and for rotation by a user between a lower orientation to maintain paint within the container and an upper orientation to allow the dispensing of paint from the container; and a stirrer positioned within the container having a vertical shaft with an adaptor at its upper end for being coupled to a drill for rotation thereof and having a lower end adjacent to the threaded opening, the stirrer including three equally spaced blades in a generally V-shaped configuration each with a lower end coupled with respect to the lower end of the vertical shaft and each having an upper end positioned adjacent to the upper end of the lower portion of the container, the lower portion of the container and the blades being essentially parallel with respect to each other and forming an interior angle of between about 30 and 60 degrees from the axis of the container and shaft.

* * * * *